US011478843B2

(12) United States Patent
Teng et al.

(10) Patent No.: US 11,478,843 B2
(45) Date of Patent: Oct. 25, 2022

(54) MANDREL COLLECTOR

(71) Applicant: MOBILETRON ELECTRONICS CO., LTD., Taichung (TW)

(72) Inventors: Cheng-I Teng, Taichung (TW); Tung-Chin Kuo, Taichung (TW)

(73) Assignee: MOBILETRON ELECTRONICS CO., LTD., Taichung (TW)

( * ) Notice: Subject to any disclaimer, the term of this patent is extended or adjusted under 35 U.S.C. 154(b) by 0 days.

(21) Appl. No.: 17/507,092

(22) Filed: Oct. 21, 2021

(65) Prior Publication Data

US 2022/0134412 A1 May 5, 2022

(30) Foreign Application Priority Data

Nov. 5, 2020 (TW) ..... 109138713

(51) Int. Cl.
*B21J 15/32* (2006.01)
*B21J 15/10* (2006.01)
*B21J 15/26* (2006.01)

(52) U.S. Cl.
CPC ..... *B21J 15/326* (2013.01); *B21J 15/105* (2013.01); *B21J 15/26* (2013.01)

(58) Field of Classification Search
CPC ..... B21J 15/105; B21J 15/326; B21J 15/38
See application file for complete search history.

(56) References Cited

U.S. PATENT DOCUMENTS 4,866,972 A * 9/1989 Schwab ..... B21J 15/105 72/453.17

FOREIGN PATENT DOCUMENTS

CN 2264626 Y 10/1997
CN 204565044 U 8/2015
DE 202014100682 U1 * 4/2014 ..... B21J 15/043

OTHER PUBLICATIONS

Search report for TW109138713, dated Mar. 29, 2021, Total of 1 page.
English abstract for CN2264626, Total of 1 page.
English abstract for CN204565044, Total of 1 page.

* cited by examiner

*Primary Examiner* — Matthew P Travers
(74) *Attorney, Agent, or Firm* — Apex Juris, PLLC; Hilde Coeckx

(57) ABSTRACT

A mandrel collector includes a case body and an end plate. The case body has a connecting end for being connected to a rivet gun. The end plate is engaged with the case body and is opposite to the connecting end. The end plate has at least one receiving hole, wherein a hole section of the receiving hole is a hexagonal hole with six walls. The walls include three first walls and three second walls. Each of the first walls is connected between adjacent two of the second walls. The hole section is defined to have a central axis and a reference plane perpendicular to the central axis. On the reference plane, a side length of at least one of the first walls is smaller than side lengths of the second walls. With such design, the receiving hole could receive a head of an adapter and could rotate the adapter as a screwdriver.

11 Claims, 12 Drawing Sheets

MANDREL COLLECTOR

BACKGROUND OF THE INVENTION

Technical Field

The present invention relates generally to a rivet gun, and more particularly to a mandrel collector for collecting the mandrel of the rivet.

Description of Related Art

A conventional rivet gun includes a riveting portion and a mandrel exiting portion, wherein the riveting portion is for being mounted with an adapter and is adapted to pull a rivet. The rivet has a mandrel and a rivet head. The rivet head passes through perforations of two objects, and the mandrel is inserted through the adapter. The adapter is driven by the riveting portion to pull the rivet leading the rivet head to deform. After the mandrel is broken, the rivet head could fix the two objects together. The broken mandrel is removed through a mandrel exiting portion. For preventing the mandrel removed from the mandrel exiting portion from missing or dropping, the rivet gun is disposed with the mandrel collector for collecting the mandrel.

However, when a user is going to disassemble the adapter, a wrench needs to be used by the user to disassemble the adapter from the riveting portion. The disassembled adapter needs to be properly stored and preserved, for example putting it into a storage box or a storage bag, for avoiding missing. When another adapter (with a different size) needs to be mounted to the riveting portion, the adapter needs to be taken out of the storage box to mount. When either the disassembled adapter is unintentionally missed or the user forgets to bring the storage box, the storage bag, or the wrench, the rivet gun cannot be used conveniently.

BRIEF SUMMARY OF THE INVENTION

In view of the above, the primary objective of the present invention is to provide a mandrel collector which could receive an adapter.

Additionally, another primary objective of the present invention is to provide a mandrel collector which could be used to rotate the adapter.

The present invention provides a mandrel collector that is adapted to be detachably mounted to the rivet gun for collecting at least one mandrel that exits from the rivet gun, wherein the rivet gun is detachably disposed with an adapter. The adapter includes a head in a shape of hexagonal prism and having an outer circumference. An O-ring is fitted around the head. The mandrel collector includes a case body and an end plate. The end plate is engaged with the case body and opposite to the connecting end. The end plate has at least one receiving hole, wherein the receiving hole has a hole section that is a hexagonal hole and has six walls. The six walls include three first walls and three second walls, wherein each of the first walls is connected between adjacent two of the second walls. The hole section is defined to have a central axis and a reference plane that is perpendicular to the central axis. On the reference plane, a side length of at least one of the three first walls is smaller than a side length of each of the three second walls. The hole section is adapted to receive the head of the adapter.

With such design, the receiving hole could store the adapters, thereby avoiding the adapters that are not mounted on the rivet gun to be missed. Additionally, the user could drive the head of the adapter to rotate by using the end plate with the receiving hole, so that the additional tool for rotating the adapter is not needed.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
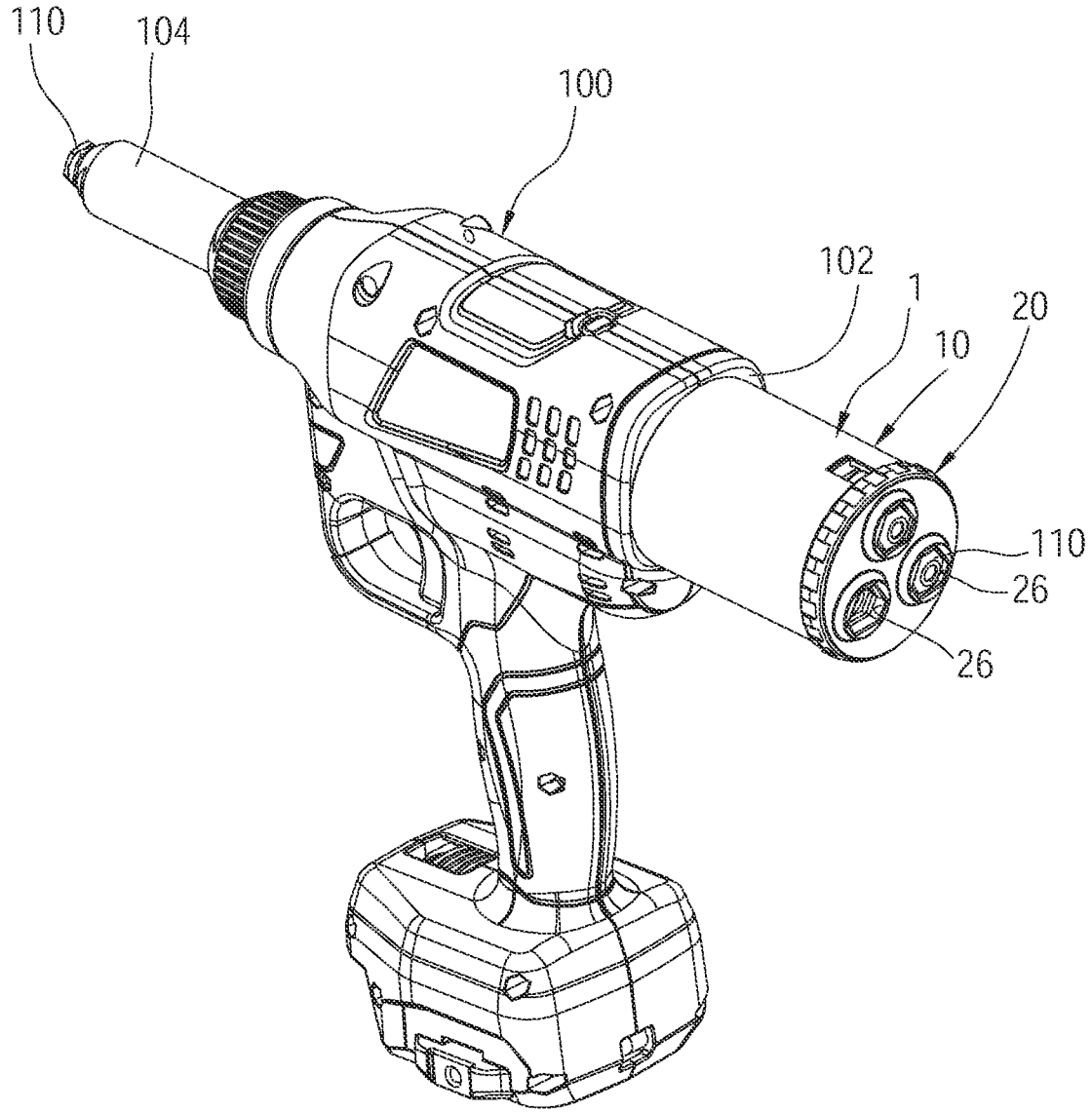
FIG. 1 is a perspective view of the rivet gun with the mandrel collector of a first embodiment according to the present invention.
Figure 2:
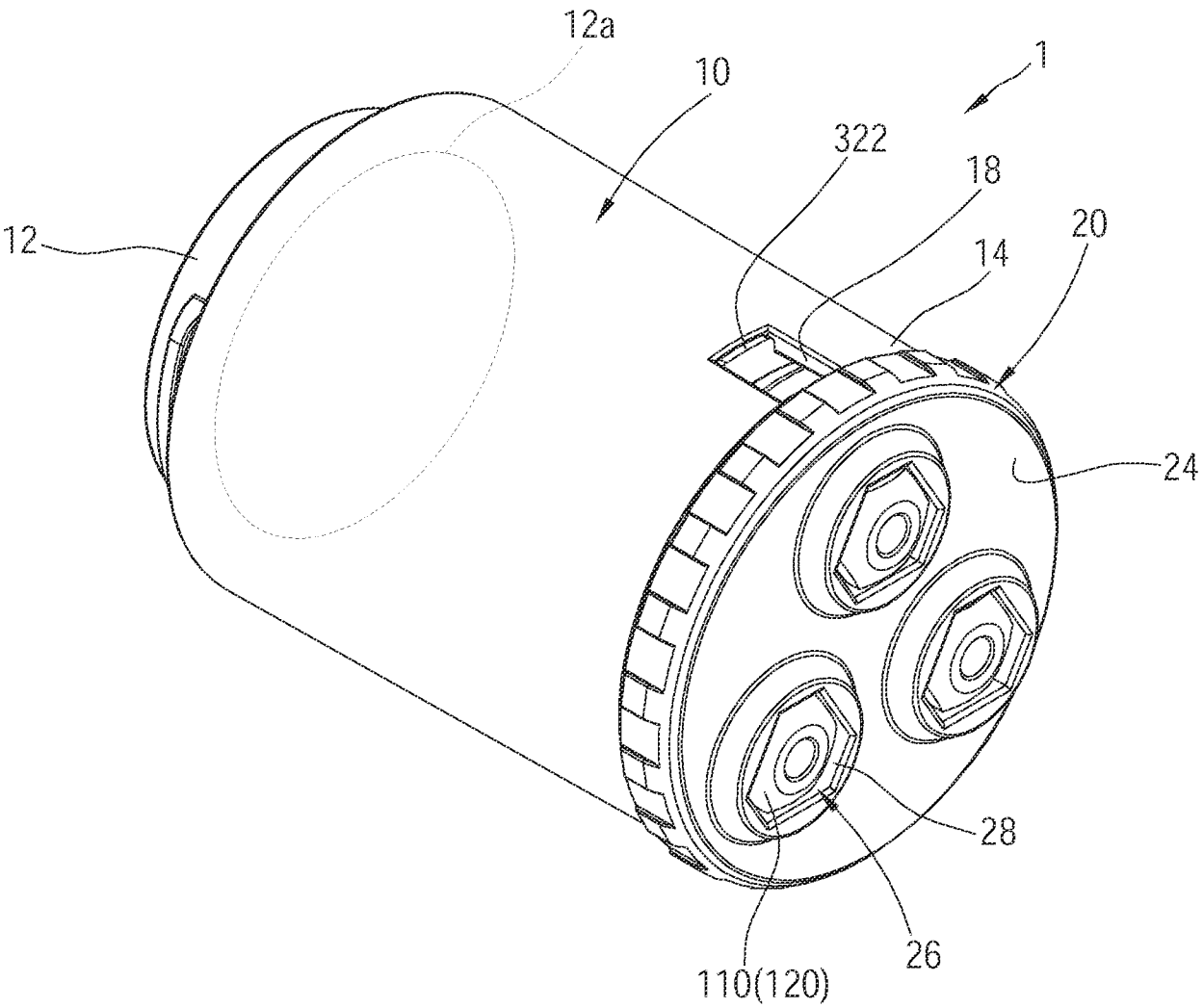
FIG. 2 is a perspective view of the mandrel collector of the first embodiment according to the present invention.
Figure 3:
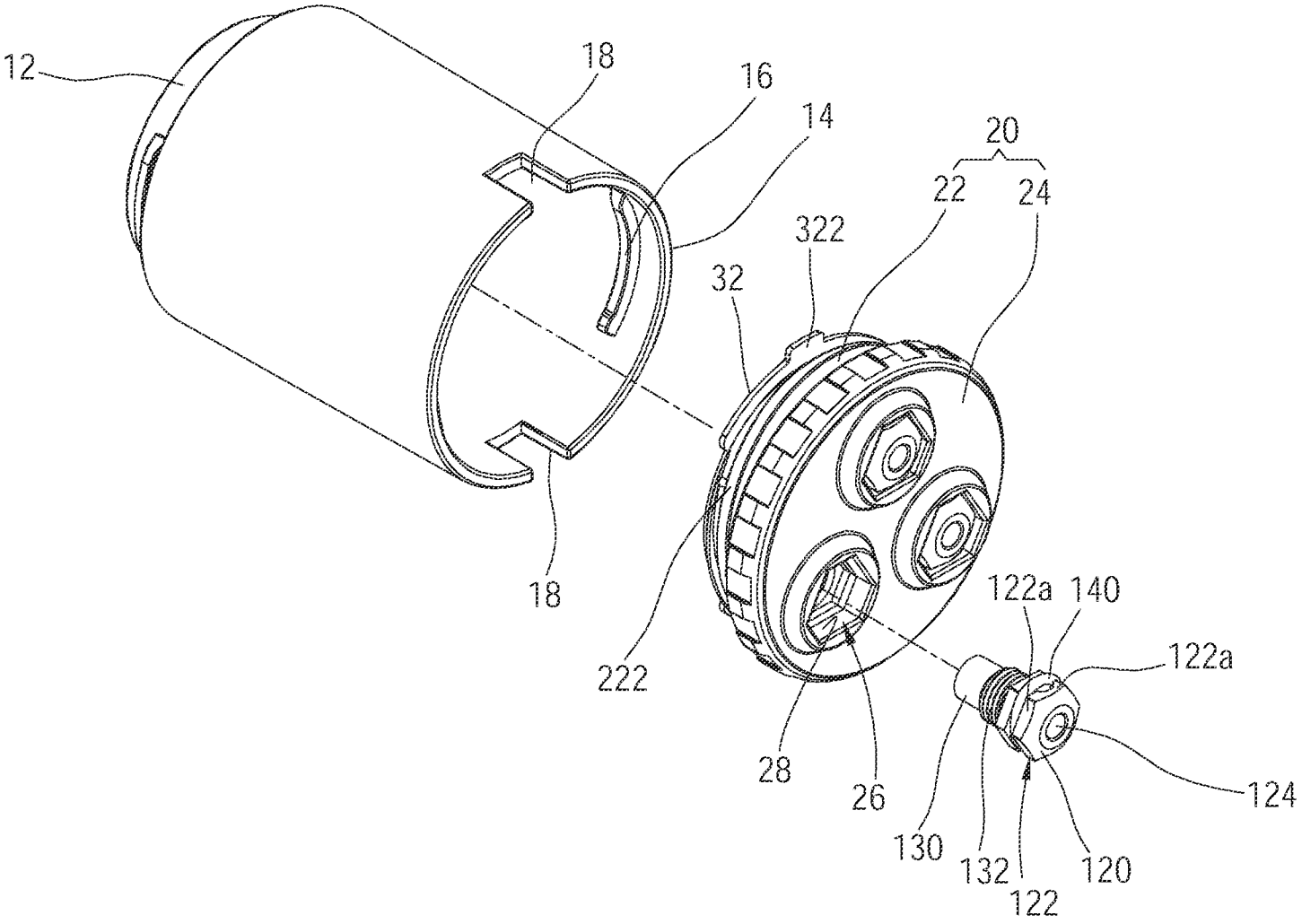
FIG. 3 is an exploded view of the mandrel collector of the first embodiment according to the present invention.
Figure 4:
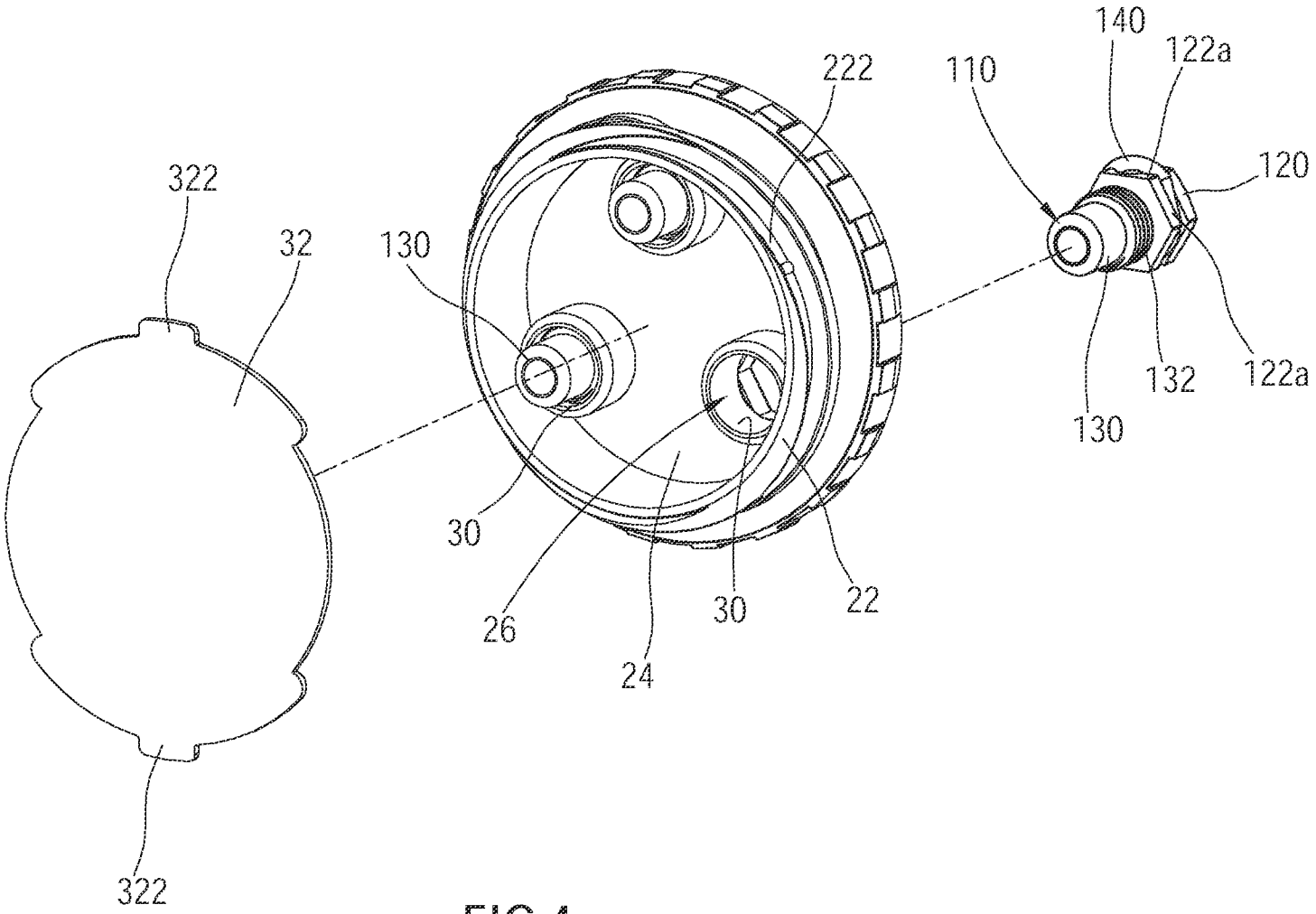
FIG. 4 is an exploded view of the end plate and the separating plate of the mandrel collector of the first embodiment according to the present invention.
Figure 5:
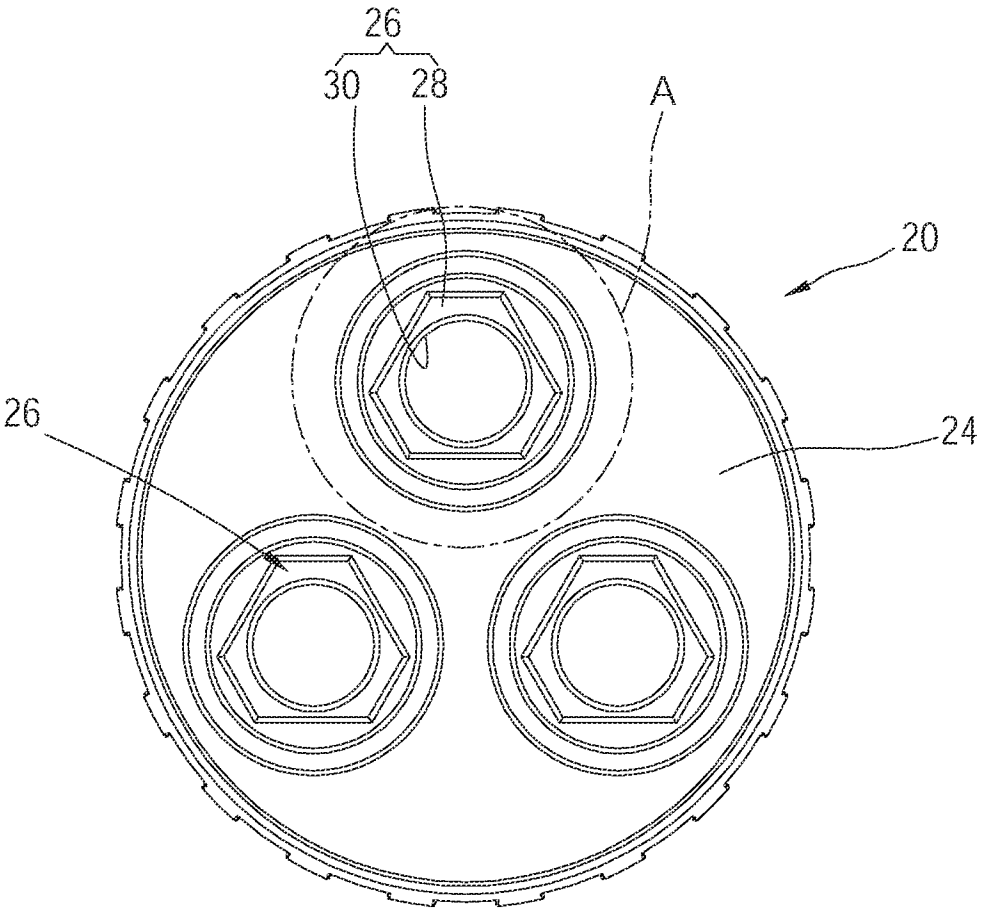
FIG. 5 is a front view of the end plate of the first embodiment according to the present invention.
Figure 6:
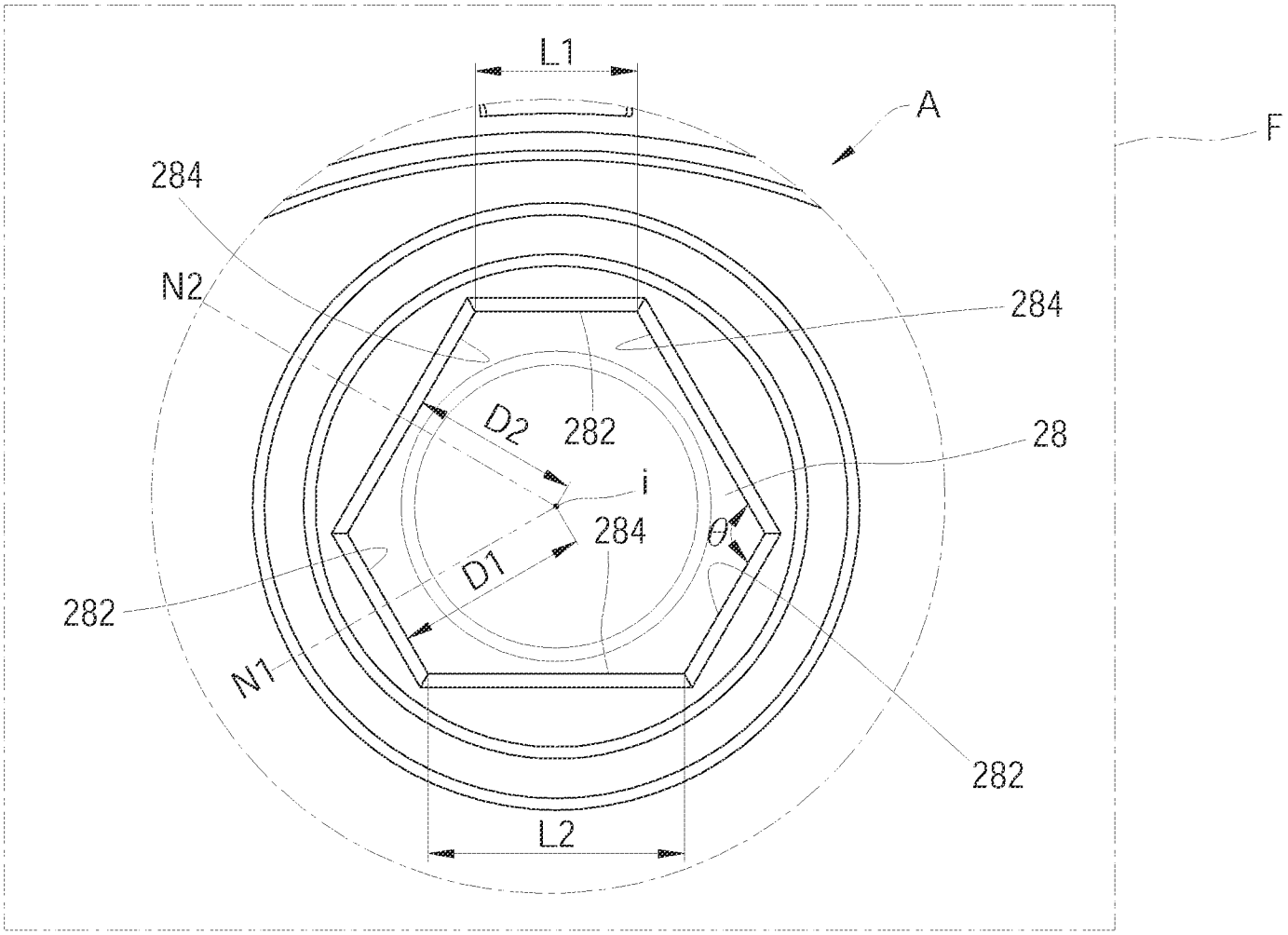
FIG. 6 is an enlarged partial view of a marked region A in FIG. 5.
Figure 7:
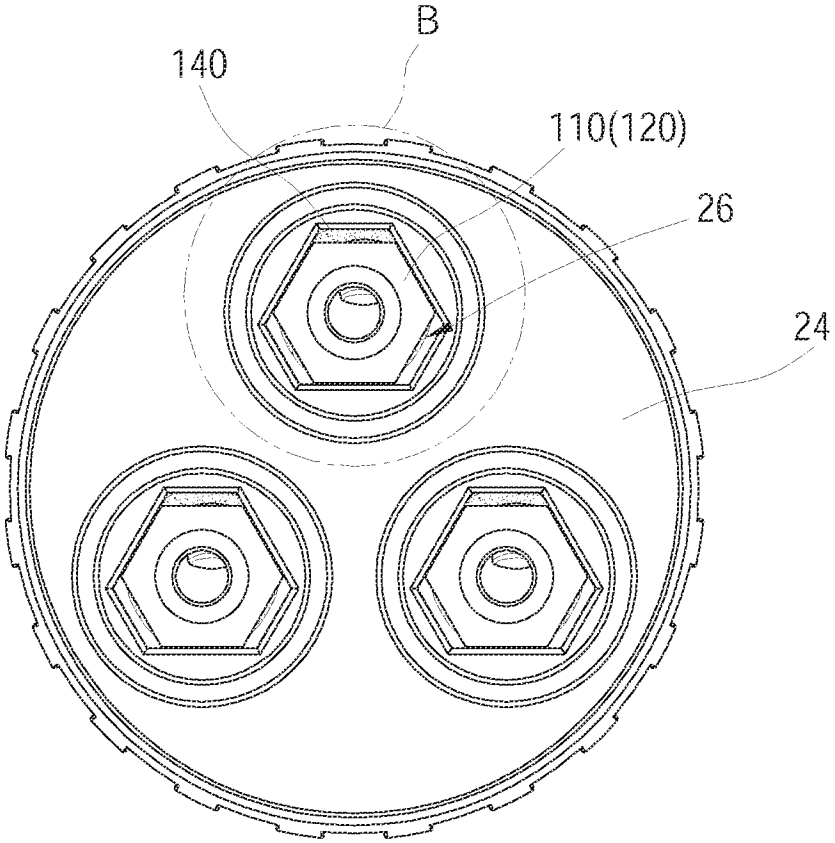
FIG. 7 is a front view of the end plate of the first embodiment according to the present invention, showing the adapters are received in the end plate.
Figure 8:
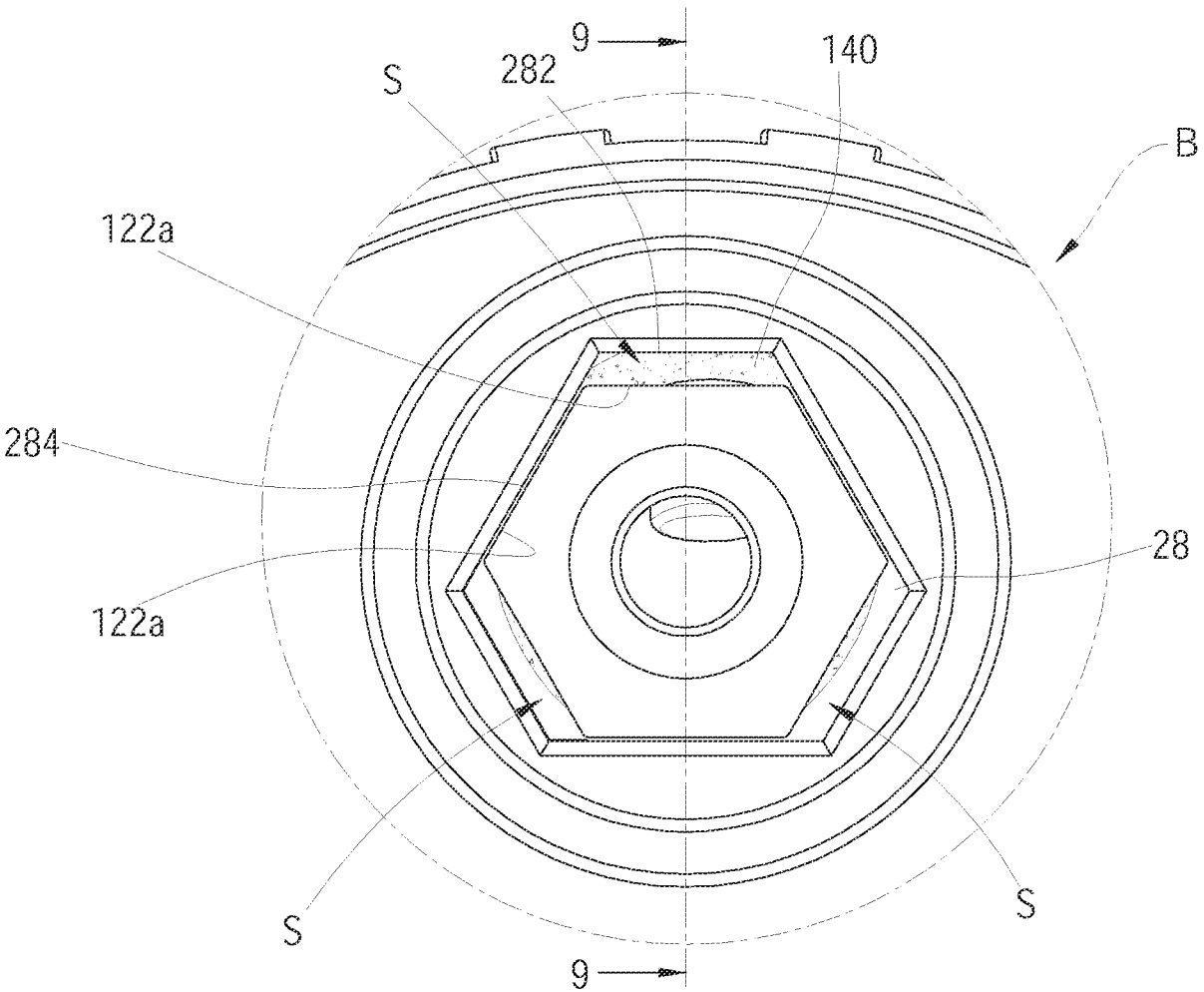
FIG. 8 is an enlarged partial view of a marked region B in FIG. 7.
Figure 9:
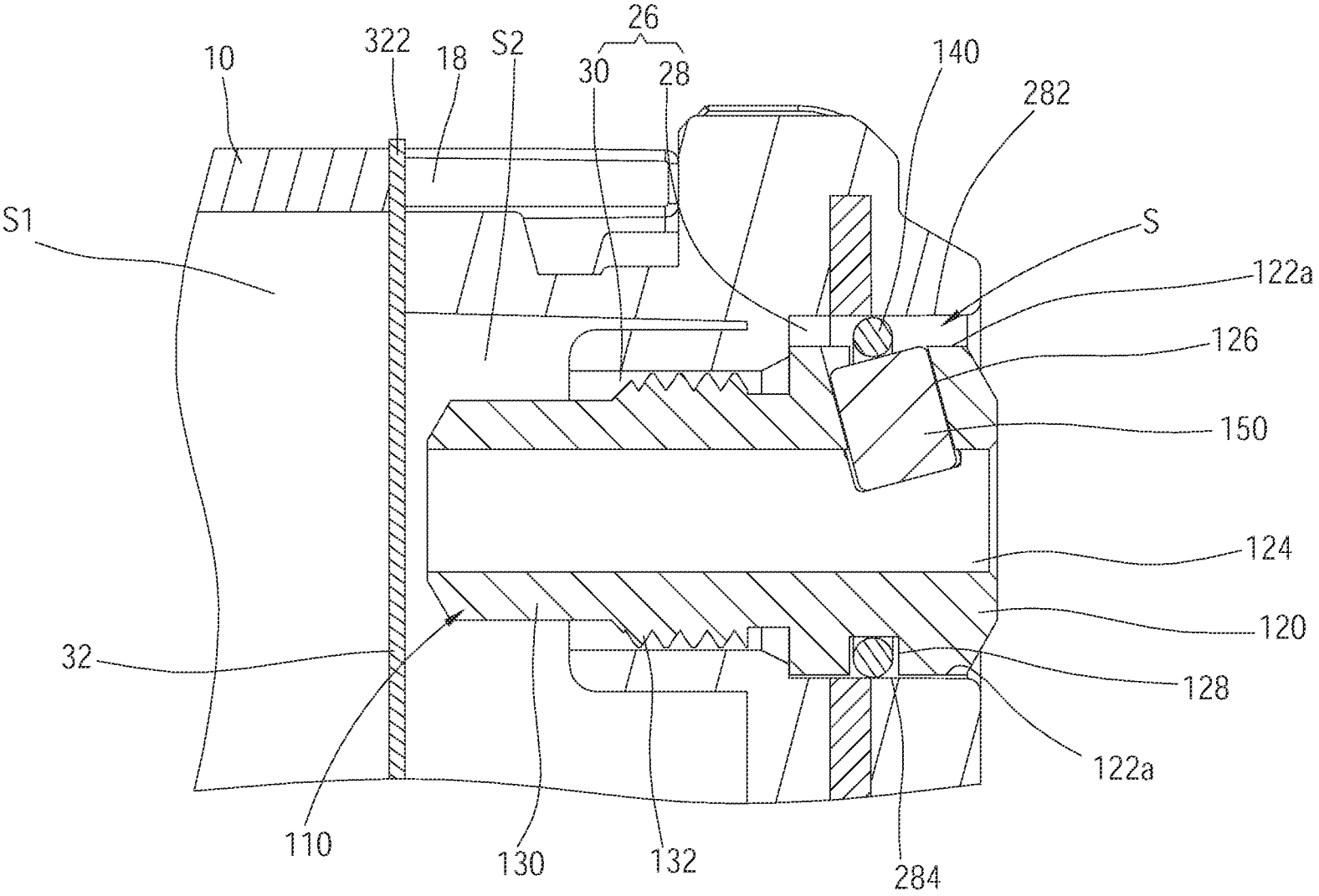
FIG. 9 is a partially sectional view taken along the 9-9 line in FIG. 8.

As illustrated in FIG. 1 to FIG. 10, a mandrel collector 1 of a first embodiment according to the present invention is detachably connected to a mandrel exiting portion 102 of a rivet gun 100. The mandrel collector 1 is adapted to receive and collect at least one mandrel (not shown) that exits through the mandrel exiting portion 102 of the rivet gun 100. A riveting portion 104 of the rivet gun 100 is detachably disposed with an adapter 110.

In the current embodiment, the rivet gun 100 could include multiple adapters 110 which are suitable for different sizes of rivets, wherein the riveting portion 104 could be mounted with one of the adapters. Since a main structure of each of the adapters 110 is approximately the same, take one of the adapters 110 as an example to describe in detail in the following. The adapter 110 includes a head 120 and a body 130. The head 120 is in a shape of hexagonal prism and has an outer circumference 122 and an axial hole 124, wherein the outer circumference 122 is constituted by six faces 122*a*. An O-ring 140 is fitted around the head 120. The axial hole 124 is provided for being inserted by a mandrel of a rivet. More specifically, the head 120 has a perforation 126 and an annular groove 128. A retaining pin 150 is disposed in the perforation 126, wherein an inner end of the retaining pin 150 is inserted into the axial hole 124. The O-ring 140 is fitted around the annular groove 128 and abuts against an outer end of the retaining pin 150, wherein a part of the O-ring 140 protrudes out of the annular groove 128 and excesses the outer circumference 122. The body 130 has a threaded portion 132 which is adapted to be screwed into the riveting portion 104 of the rivet gun 100. The outer circumference 122 of the head 120 is adapted to be held and rotated to allow the adapter 110 to be assembled with or disassembled from the riveting portion 104 of the rivet gun 100.

The mandrel collector 1 includes a case body 10 and an end plate 20, wherein the case body 10 has a connecting end 12 which is adapted to be connected to the mandrel exiting portion 102 of the rivet gun 100. The connecting end 12 has an opening 12*a* which is provided for a mandrel exiting from the mandrel exiting portion 102 to pass through and enter into the mandrel collector 1. In the current embodiment, the case body 10 is cylindrical, wherein another end of the case body 10 is an opening end 14 which is opposite to the connecting end 12. At the opening end 14 of the case body 10, an engaged portion, which is a protrusion 16 as an example, is disposed on an inner wall of the case body 10. The opening end 14 of the case body 10 has two slots 18.

The end plate 20 is engaged with the case body 10 and is opposite to the connecting end 12. In the current embodiment, the end plate 20 is detachably engaged with the case body 10. The end plate 20 includes an engaging portion 22 and a plate body 24. The engaging portion 22 has a thread 222. The opening end 14 of the case body 10 is fitted around the engaging portion 22 by engaging the thread 222 of the engaging portion 22 and the protrusion 16 of the opening end 14 of the case body 10 to form a threaded connection. The plate body 24 of the end plate 20 has at least one receiving hole 26, wherein each of the at least one receiving hole 26 could receive one of the adapters 110 or drive one of the adapters 110 to rotate. In the current embodiment, the at least one receiving hole 26 includes a plurality of receiving holes 26. Since the receiving holes 26 have the same structure, exemplify one of the receiving holes 26 in detail in the following.

The receiving hole 26 includes a first section 28 and a second section 30, wherein the first section 28 is a hole section defined in the present invention. The first section 28 of the receiving hole 26 is a hexagonal hole and has six walls, wherein the six walls include three first walls 282 and three second walls 284. Each of the first walls 282 is arranged and connected between adjacent two of the second walls 284, wherein an angle θ that is formed between each of the first walls 282 and adjacent one of the second walls is 60 degrees. A first section 28 of the receiving hole 26 is defined to have a central axis i and a reference plane F which is perpendicular to the central axis i. On the reference plane F, a side length L1 of at least one of the three first walls 282 is smaller than a side length L2 of each of the three second walls 284. In the current embodiment, on the reference plane F, the side lengths L1 of the first walls 282 are equal, and the side lengths L2 of the second walls 284 are equal, so that the side length L1 of each of the first walls 282 is smaller than the side lengths L2 of the second walls 284. The side length L2 of each of the second walls is 1.5 to 2 times of the side length L1 of each of the first walls 282. In the current embodiment, the side length L2 of each of the second walls is 9.4 mm as an example, and the side length L1 of each of the first walls 282 is 5.9 mm as an example, so that the side length L2 of each of the second walls is approximately 1.59 times of the side length L1 of each of the first walls 282. On the reference plane F, the side length L1 of each of the first walls 282 is smaller than a length of each of the faces 122*a* of the outer circumference 122 of the head 120 of the adapter 110, and the side length L2 of each of the second walls is greater than the length of each of the faces 122*a* of the outer circumference 122 of the head 120.

A first normal line N1 of each of the first walls 282 is defined to be perpendicular to one of the first walls 282 and to pass through the central axis i, and a second normal line N2 of each of the second walls 284 is defined to be perpendicular to one of the second walls 284 and to pass through the central axis i. Along the first normal line N1 of the first wall 282, a distance between the central axis i and the first wall 282 is defined as a first distance DE Along the second normal line N2 of the second wall 284, a distance between the central axis i and the second wall 284 is defined as a second distance D2. The second distance D2 is smaller than the first distance D1, wherein the second distance D2 is 0.8 to 1.5 mm shorter than the first distance DE In the current embodiment, the second distance D2 is 6.1 mm as an example, and the first distance D1 is 7.1 mm as an example. The second distance D2 is 1 mm shorter than the first distance D1, wherein the first distance D1 is 1.164 times of the second distance D2.

The second section 30 of the receiving hole 26 is a circular hole and has a hole wall. The second section 30 of the receiving hole 26 is adapted to receive the body 130 of the adapter 110. In another embodiment, a shape of the second section 30 could be the same as that of the first section 28, namely the second section 30 could be a hexagonal hole as well.

According to the structure of the receiving hole 26 mentioned above, the adapter 110 could be put into the receiving hole 26 to allow the body 130 of the adapter 110 to be put into the second section 30, and the head 120 of the adapter 110 to be put into the first section 28. Since a receiving space S is formed between each of the first walls 282 and one of the faces 122*a* of the head 120 of the adapter 110, the O-ring 140 is urged by the second walls 284 of the receiving hole 26 to deform during a process of plugging the head 120 into the first section 28 of the receiving hole 26. A deformed part of the O-ring 140 is moved to the receiving spaces S, so that the head 120 and the O-ring 140 could be successfully inserted into the first section 28. A part of the body 130 protrudes out of the second section 30. In other words, the deformation of the O-ring 140 does not hinder the head 120 from entering the first section 28, so that the head 120 could be properly and effectively fixed into the receiving hole 26. Additionally, the O-ring 140 abuts against the walls of the first section 28, avoiding the head 120 disengaging from the receiving hole 26. Preferably, a gap is maintained between each of the second walls 284 and the faces 122*a* of the head 120, so that the adapter 110 could be easily took out from the receiving hole 26. When the adapter 110 needs to be withdrawn from the receiving hole 26, by simply pushing the body 130 from an inner side of the end plate 20, the adapter 110 could be taken out.

Additionally, in the current embodiment, the mandrel collector 1 could further include a separating plate 32, wherein the separating plate 32 is disposed between the case body 10 and the end plate 20 and divides a space between the case body 10 and the end plate 20 into a first space S1 and a second space S2. The first space 51 communicates with the opening 12*a* of the case body 10, and the second space S2 communicates with the receiving holes 26. The separating plate 32 has two lugs 322. The two lugs 322 are located in the two slots 18, respectively. The engaging portion 22 of the end plate 20 abuts against the separating plate 32 to allow the two lugs 322 of the separating plate 32 to be received into the two slots 18, thereby fixing a position of the separating plate 32. The mandrels removing from the mandrel exiting portion 102 of the rivet gun 100 could be collected and stored in the first space 51. Since the separating plate 32 blocks communication between the first space S1 and the second space S2, the mandrels collected in the first space S1 are not going to drop out through the receiving holes 26.

Figure 10:
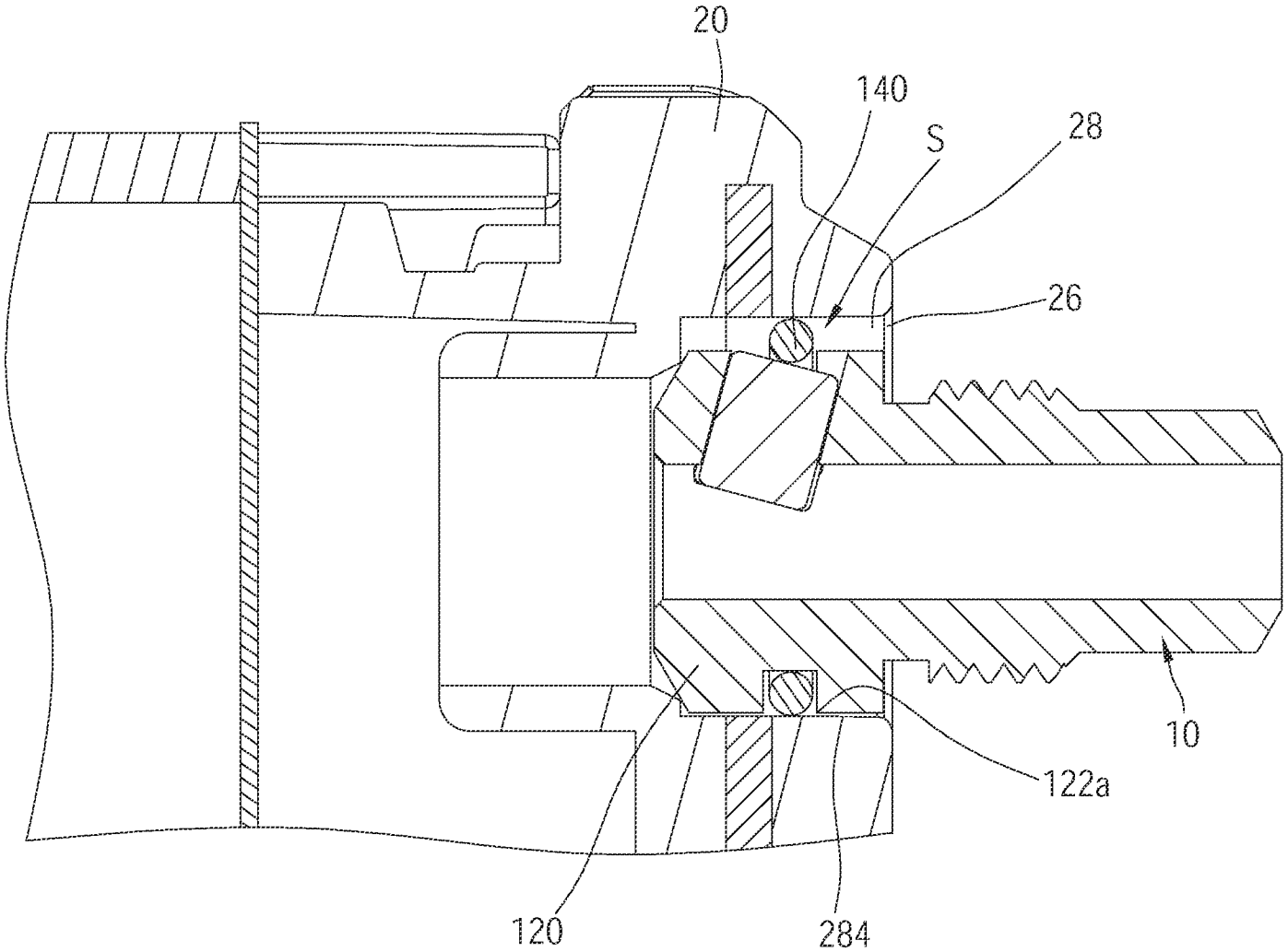
FIG. 10 is a schematic diagram, showing the head of the adapter is received in the first section of the receiving hole.

As illustrated in FIG. 10, when a user would like to rotate the adapter 110, the end plate 20 could be removed and the head 120 of the adapter 110 could be plugged into the first section 28 of the receiving hole 26. A deformed part of the O-ring 140 could enter into the receiving space S. Since the three second walls 284 of the first section 28 of each of the receiving holes 26 could abut against and clamp corresponding three faces 122*a* of the head 120 of the adapter 110, so that the adapter 110 could be rotated as the end plate 20 is rotated. By utilizing the end plate 20 to rotate the adapted 110, the adapter 110 could be easily screwed into or disassembled from the riveting portion 104 of the rivet gun 100.

Figure 11:
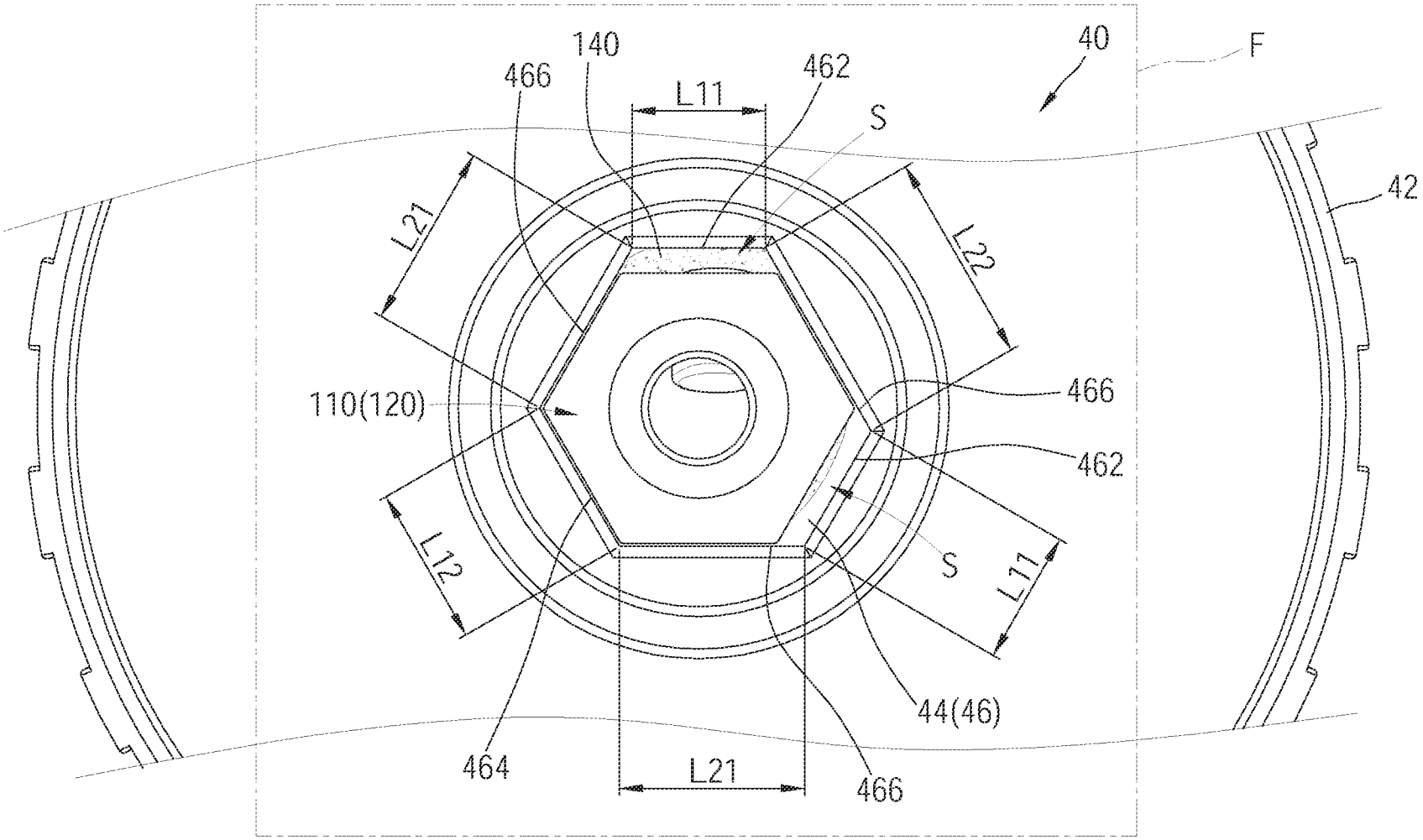
FIG. 11 is a partially front view of the end plate of a second embodiment according to the present invention, showing the adapter is received in the end plate.

FIG. 11 illustrate an end plate 42 of a mandrel collector 40 of a second embodiment according to the present invention, wherein the end plate 42 of the mandrel collector 40 of the second embodiment has almost the same structure as that of the first embodiment, except that a number of the receiving hole 44 on the end plate 42 is one and is located at a center of the end plate 42. Additionally, on the reference plane F, a side length L11 of the two first walls 462 is smaller than another side length L12 of the one first wall 464 and is smaller than the side lengths L21, L22 of three second walls 466. In other words, the first section 28 of the receiving hole 44 includes three first walls, wherein the side length L12 of one of the first walls is greater than the side lengths L11 of the other two of the first walls. Besides, the side lengths L21 of each two of the second walls 466 is smaller than the side length L22 of the other one of the second walls 466. The receiving spaces S formed between each of the two first walls 462 and the head 120 of the adapter 110 could receive the deformed part of the O-ring 140 as well.

Figure 12:
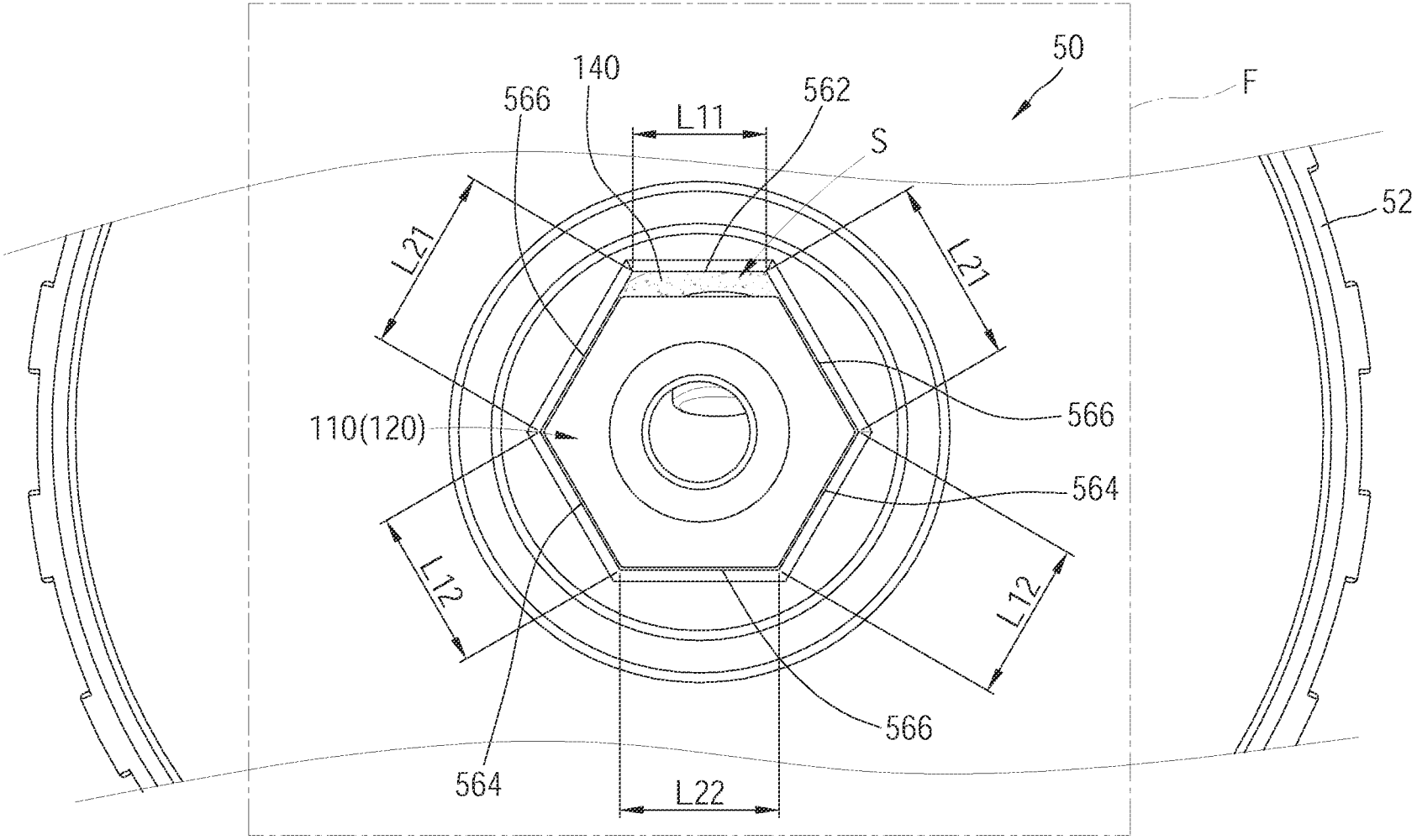
FIG. 12 is a partially front view of the end plate of a third embodiment according to the present invention, showing the adapter is received in the end plate.

FIG. 12 illustrates an end plate 52 of a mandrel collector 50 of a third embodiment according to the present invention, wherein the end plate 52 of the mandrel collector 50 of the third embodiment has almost the same structure as that of the second embodiment, except that on the reference plane F, a side length L11 of one first wall 562 is smaller than another side length L12 of each two the first walls 564 and is smaller than side lengths L21, L22 of each of the second walls 566. In other words, the first section 28 of the receiving hole 56 includes three first walls, wherein the side length L11 of one of the first walls is smaller than the side lengths L12 of the other two of the first walls. Besides, the side length L21 of one of the second walls 466 is smaller than the side lengths L22 of the other two of the second walls 466. Similarly, the receiving space S formed between the first wall 562 and the head 120 could receive the deformed part of the O-ring 140.

In the embodiments described above, the end plate could be disengaged from the case body. However, in other embodiment, the case body and the end plate could be integrally formed as a monolithic unit.

With such design, the receiving holes on the mandrel collector could receive the adapters, thereby preventing the adapters which are not mounted on the riveting portion of the rivet gun from being gone. Additionally, the receiving hole could be utilized to rotate the adapter, so that the user does not need to prepare additional tools for rotating the adapters.

It must be pointed out that the embodiment described above is only a preferred embodiment of the present invention. All equivalent structures which employ the concepts disclosed in this specification and the appended claims should fall within the scope of the present invention.

What is claimed is:

1. A mandrel collector adapted to be detachably mounted to a rivet gun and to collect at least one mandrel that exits from the rivet gun, wherein the rivet gun is detachably disposed with an adapter; the adapter comprises a head in a shape of a hexagonal prism and an outer circumference, and an O-ring is fitted around the head; wherein the mandrel collector comprises:

a case body having a connecting end, wherein the connecting end has an opening; the connecting end is adapted to be connected to the rivet gun, and the opening is provided for the at least one mandrel passing through;

an end plate engaged with the case body and opposite to the connecting end; the end plate has at least one receiving hole, wherein each receiving hole has a hole section that is a hexagonal hole and has six walls; the six walls comprise three first walls and three second walls; each of the first walls is connected between adjacent two of the second walls; the hole section is defined to have a central axis and a reference plane that is perpendicular to the central axis; on the reference plane, a side length of at least one of the three first walls is smaller than a side length of each of the three second walls; the hole section is adapted to receive the head of the adapter such that a receiving space is formed between the outer circumference of the head of the adapter and the at least one of the three first walls which has the side length smaller than the side length of each of the three second walls and such that when the O-ring is pressed and deformed, a deformed part of the O-ring enters into the receiving space.

2. The mandrel collector as claimed in claim 1, wherein on the reference plane, a side length of each of at least two of the three first walls is smaller than the side lengths of the second walls.

3. The mandrel collector as claimed in claim 1, wherein on the reference plane, side lengths of the first walls are equal, and the side lengths of the second walls are equal, so that the side lengths of the first walls are smaller than the side lengths of the second walls.

4. The mandrel collector as claimed in claim 3, wherein a first normal line of each of the first walls is defined to pass through the central axis, and a second normal line of each of the second walls is defined to pass through the central axis; along the first normal line of each of the first walls, a distance between the central axis and a respective one of the first walls is defined as a first distance; along the second normal line of each of the second walls, a distance between the central axis and a respective one of the second walls is defined as a second distance, wherein the second distance is smaller than the first distance.

5. The mandrel collector as claimed in claim 4, wherein the second distance is 0.8 to 1.5 mm shorter than the first distance.

6. The mandrel collector as claimed in claim 3, wherein the outer circumference of the head of the adapter comprises six faces; on the reference plane, the side length of each of the first walls is smaller than a length of each of the faces of the outer circumference, and the side length of each of the second walls is greater than the length of each of the faces of the outer circumference.

7. The mandrel collector as claimed in claim 1, wherein an angle that is formed between each of the first walls and an adjacent one of the second walls is 60 degrees.

8. The mandrel collector as claimed in claim 1, wherein the end plate is detachably engaged with the case body.

9. The mandrel collector as claimed in claim 8, further comprising a separating plate which is disposed between the case body and the end plate, wherein a space between the case body and the end plate is divided into a first space and a second space by the separating plate; the first space communicates with the opening of the case body, and the second space communicates with the at least one receiving hole.

10. The mandrel collector as claimed in claim 9, wherein the case body has an opening end which is opposite to the connecting end, the opening end of the case body has two slots; the separating plate has two lugs which are located in the two slots.

11. The mandrel collector as claimed in claim 1, wherein the case body and the end plate are integrally formed as a monolithic unit.

* * * * *